United States Patent [19]

Sugihara, Kunihiko et al.

[11] 4,033,306

[45] July 5, 1977

[54] EXHAUST GAS RECIRCULATION SYSTEM

[75] Inventors: Sugihara, Kunihiko; Kazuo Hioki; Shigeo Muranaka, all of Yokohama, Japan

[73] Assignee: Nissan Motor Co., Ltd., Yokohama, Japan

[22] Filed: June 9, 1975

[21] Appl. No.: 585,055

[30] Foreign Application Priority Data

June 11, 1974 Japan ..... 49-66938

[52] U.S. Cl. ..... 123/119 A

[51] Int. Cl.[2] ..... F02M 25/06

[58] Field of Search ..... 123/119 A

[56] References Cited

UNITED STATES PATENTS

| | | | |
|---|---|---|---|
| 3,507,260 | 4/1970 | Walker | 123/119 A |
| 3,768,452 | 10/1973 | Lewis | 123/119 A |
| 3,842,814 | 10/1974 | Bier | 123/119 A |
| 3,924,587 | 12/1975 | Murphy | 123/119 A |

*Primary Examiner*—Wendell E. Burns

[57] ABSTRACT

A valve, the opening degree of which is decreased with rise in the intake manifold vacuum is located in an exhaust gas recirculation conduit at the downstream of another valve, the opening degree of which is increased with rise in the vacuum at a port opening to the carburetor in the neighborhood of the periphery of the throttle valve in its closed position.

4 Claims, 4 Drawing Figures

EXHAUST GAS RECIRCULATION SYSTEM

This invention is generally related to a system of feeding internal combustion engine exhaust gases into the intake manifold and particularly to an improved recirculation system.

It is recognized that the emission of nitrogen oxides by an internal combustion engine can be substantially reduced or eliminated by recirculation of some exhaust gases into the intake manifold of the engine. To maximize the performance of the engine, however, it is desirable to feed a volume of exhaust gas proportional to the speed of the engine under average operating conditions and to close off the feed of exhaust gas during idling, severe load and high speed operation of the engine.

Such exhaust gas recirculation systems are usually equipped with recirculation control valves which are located in the exhaust recirculation conduit and are operated by the venturi vacuum in the engine carburetor for controlling the flow rate of the exhaust gas fed into the intake manifold in accordance with the particular engine condition as described.

While the venturi vacuum in proportional to the engine speed, it does not directly indicate the degree of throttle opening and engine load. Accordingly, it has already been proposed to control the opening degree of such venturi-vacuum operated valve auxiliarily by the vacuum in the intake manifold for a more accurate response to the transient operating conditions such as acceleration and deceleration.

Besides, the venturi vacuum is relatively low and may be insufficient for operating and recirculation control valve. To solve this problem, there is known such a system with servo means or the like which amplifies the venturi vacuum to the recirculation control valve.

An object of the present invention is to provide an improved exhaust gas recirculating system which substantially obviates the drawbacks and difficulties in the conventional systems as mentioned.

Another object of the present invention is to provide a compact, easily assembled valve arrangement in the aforementioned type of a system.

According to the invention, a recirculation control valve is operated by vacuum prevailing at a vacuum port which opens to the carburetor in the neighbourhood of the periphery of the throttle flap in its closed position. Since the level of the vacuum at such vacuum port is sufficient for operating the valve, there is no need to amplify the valve operating vacuum. Furthermore, according to the invention, there is provided another recirculation control valve which is located in the recirculation conduit downstream of the aforementioned valve with respect to the gas flow through the conduit and which is operated by the intake manifold vacuum. The opening degree of the first mentioned valve increases in proportion to rise in the vacuum at the vacuum port, whereas the opening degree of the second valve decreases as the intake manifold vacuum drops. Thus, the effective open area of the recirculation conduit and therefore the rate of exhaust gas drawn into the intake manifold is controlled by the coacting two valves, offering an optimum recirculation control in any particular operating mode.

Other objects and advantages of the invention will be apparent from the following description of preferred embodiments of the invention, reference being made to the accompanying drawings wherein.

Figure 1:
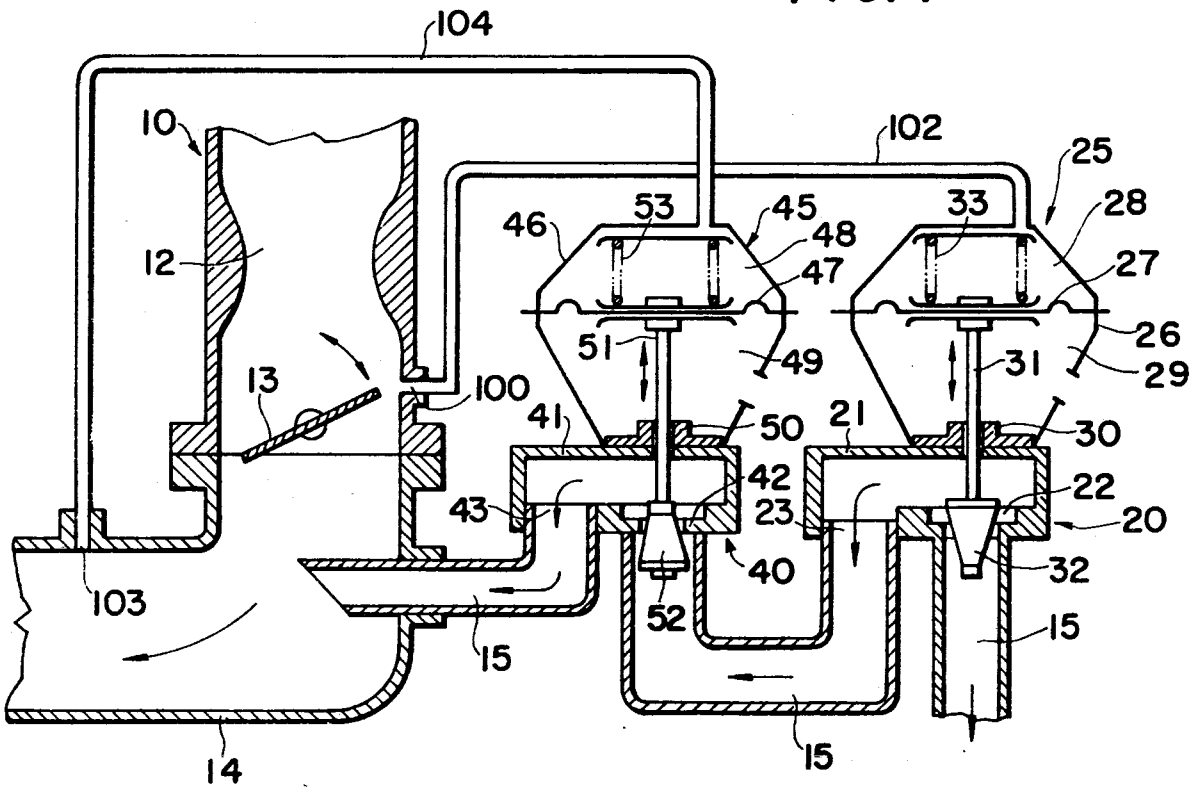
FIG. 1 is a schematic view, partly in section, of a system for controlling the recirculation exhaust gases into the intake manifold of an internal combustion engine, according to a preferred embodiment of the invention.

Throughout the Figures, a control system is shown for controlling the recirculation of exhaust gases into the intake manifold of an automotive internal combustion engine, only certian parts of which engine are shown. The engine includes a carburetor 10 having an air intake incorporating the usual venturi throat 12 and the throttle flap 13. The engine also includes a conventional intake manifold 14 and an exhaust manifold (not shown). An exhaust gas recirculation conduit 15 connects the intake manifold 14 and the exhaust manifold in the known manner to feed exhaust gas in the arrow-indicated direction.

The control system of the invention comprises two separate valves 20 and 40 of the diaphragm-operable type, serially arranged and located in the recirculation conduit. The valve 20 comprises a body 21 having an inlet port 22, leading from the exhaust manifold, and an outlet port 23. A vacuum servo 25 unseats and seats a valve head 32 from and on a valve seat (no numeral) formed in the inlet port 22.

The vacuum servo 25 is a conventional diaphragm assembly with a housing 26 and a flexible diaphragm 27 extending transversely of the interior thereof. The diaphragm 27 is hermetically joined about its periphery to the wall of the housing 26 and partitions the housing into an upper chamber 28 (in FIG. 1) and a lower chamber 29. The chamber 28 is connected with a vacuum source through a conduit 102 as will be later described. The chamber 29 is open to atmosphere through an opening (no number) in the lower wall of the housing.

The housing 26 is rigidly supported on a retainer 30 fixed to the valve body 21 with openings (no number) formed through the retainer and the valve body in coaxial alignment with one another. A valve stem 31 is at one end connected with the diaphragm and depends therefrom through the openings mentioned. To the other end of the stem attached is the valve head 32 already mentioned which is frustoconical and tapered downwardly as an example. A compression spring 33 is interposed between the upper side of the diaphragm and the upper wall portion of the chamber 28 and urges the valve stem 31 downwardly to tend to seat the valve head 32 on the seat. When more vacuum is produced in the chamber 28 of the housing, the diaphragm 27 will be deflected upwardly by the atmospheric pressure in the chamber 29 and cause a larger opening of the valve.

Another control valve 40 is located at a portion of the recirculation conduit downstream the valve 20. The valve 40 is constructed by components such as a valve body 41 with an inlet 42 and outlet 43, a valve stem 51 and, as an example, a frustoconical valve head 52, a vacuum servo 45 enclosed in a housing 46 with a diaphragm 47, an upper chamber 48, a lower chambe 49 (in FIG. 1), a compression spring 53, in the manner just like the valve 20, except only that the valve head 52 is upwardly tapered.

With particular reference to FIG. 1, tubing connection from the vacuum source to the vacuum servos is described for the respective valves 20 and 40. vacuum port 100, as such a source of vacuum for feeding the servo 25 with vacuum, opens to the carburetor 10 in the neighbourhood of the periphery of the throttle flap 13 in its substantially closed position. A conduit 102 leading from the port 100 is connected with the upper chamber 28 of the housing 26, hence the opening degree of the valve 20 is increased overcoming the action of the spring 33 as the degree of vacuum present at the vacuum port 100 and therefore in the chamber 28 rises. According to the invention, the vacuum port 100 is so located that the vacuum thereat is at a maximum level when the throttle flap is substantially in a half-open position, as will be further described with respect to the operation of the valve 20. An intake manifold vacuum sensing port 103 directly communicates with the intake manifold 14 in this preferred embodiment and is connected with the upper chamber 48 of the housing 46 by means of another conduit 104. The valve 40 therefore tends to close as the intake manifold vacuum increases.

Figure 2:
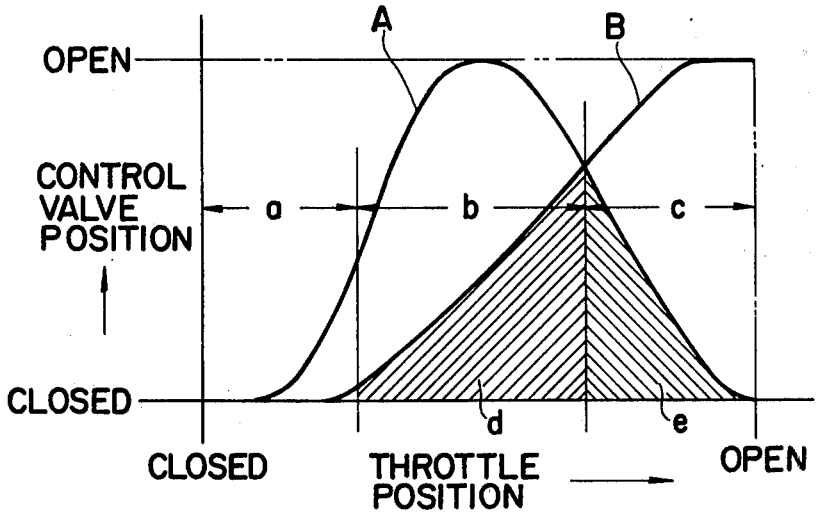
FIG. 2 is a diagrammatic view depicting the operational principle of the present invention.

The control operation of the valves 20 and 40 is more apparent from the diagram of FIG. 2, on which the throttle position is the abscissa, while the opening degree of either control valve is the ordinate. The characteristics of the respective valves 20 and 40 are thus plotted on the diagram by means of the curves A and B. Apparently, in the light load operation with closed throttle as indicated by the area *a* on the diagram, the valve 20 is closed or only slightly open, whereas the valve 40 is fully closed because of high intake manifold vacuum. Accordingly, no or a very small amount of exhaust gas is fed into the intake manifold in this mode of operation. As the throttle is moving toward an opening position for normal cruising operation *b* and reaches the half-open position or a position half-way between a fully closed and a fully open position, the vacuum at the port 100 reaches the maximum level and therefore the valve 20 is fully opened, as mentioned above. The valve 20 then tends to close with further movement of the throttle toward its wider open position. inasmuch as the vacuum at the port 100 is reduced. Meanwhile, the intake manifold vacuum at the port 103 is reduced in this area *b* so that the opening degree of the valve 40 is gradually increased. The exhaust gas feed rate is thus increased substantially linearly according to the opening degree of the throttle within the shadowed area *d* on the diagram. Upon full load operation with wide open throttle, the vacuum at the port 100 is minimized causing the valve 20 to be closed. While the valve 40 is in the open position because of low intake manifold vacuum, the recirculation rate is such that restricted by the opening degree of the valve 20, as indicated by the shadowed area *e*.

It is apparent from the foregoing that according to the invention the exhaust gas recirculation rate is relatively small during light load operation in which the discharge of nitrogen oxides is barely perceivable, whereas an increased amount of exhaust gas is fed into the intake manifold during normal cruising operation. The recirculation rate is reduced also in full load operation which does not occur frequently and therefore the atmospheric air is polluted only to a small degree.

Figure 3:
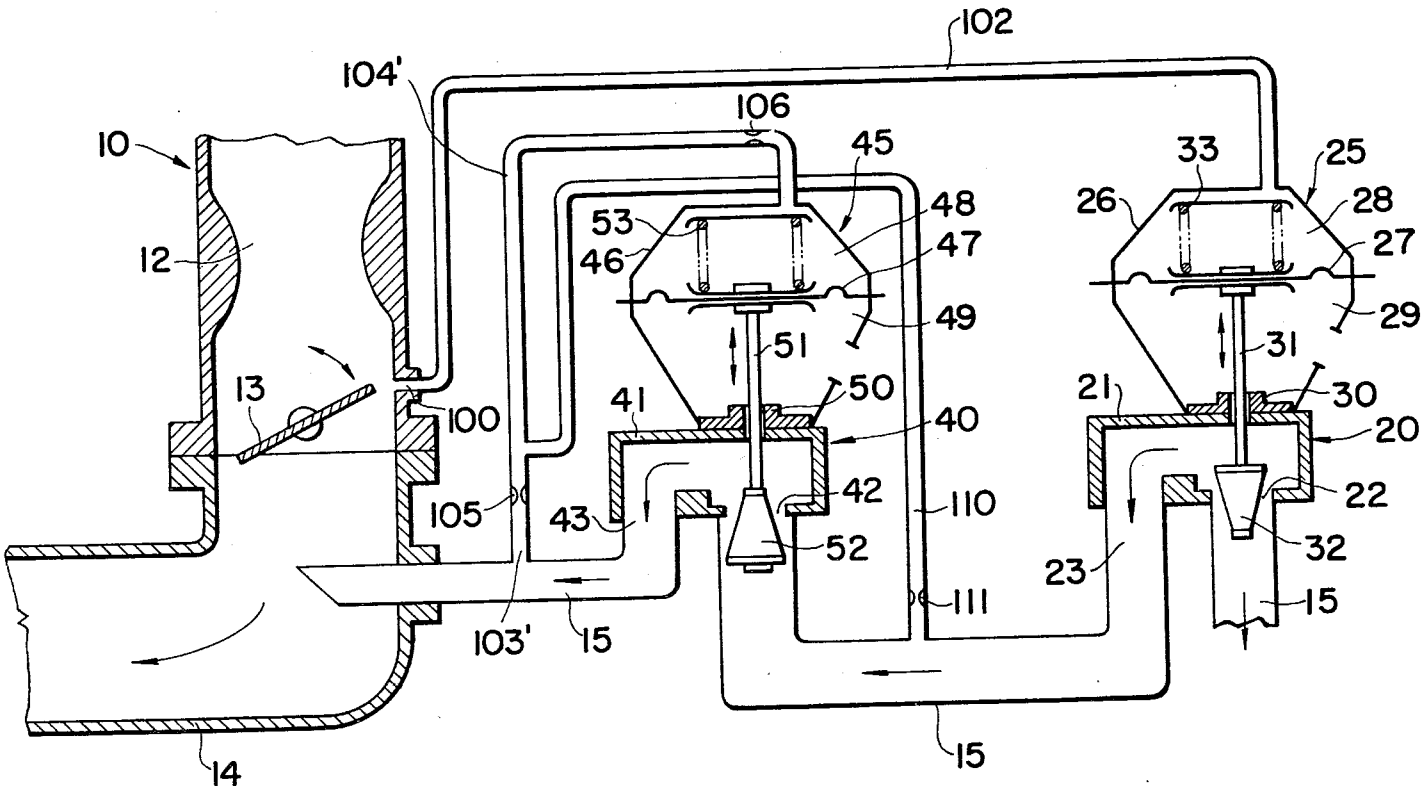
FIG. 3 is a view similar to FIG. 1 but showing the system according to another preferred embodiment of the invention.

In another preferred embodiment of FIG. 3, the intake manifold vacuum sensing port 103' opens between the outlet (no number) to the intake manifold and the outlet 43 of the valve 40 to the conduit 15. A conduit 104' establishes connection between the port 103' and the upper chamber 48 of the servo 40. The conduit 104' is formed with two metering orifices 105, 106 at the respective end portions thereof. A feedback conduit 110 branches off from the conduit 104' at a location between the metering orifices 105 and 106 near the metering orifice 105 and opens at its terminal port (no number) to a portion of the recirculation conduit 15 between the outlet 23 of the valve 20 and the inlet 43 of the valve 40. The conduit 110 is also provided with a metering orifice 111 adjacent the terminal port to the feed conduit. An abnormal increase in pressure difference between the upstream and downstream of the valve 40 in the recirculation conduit is eliminated by this arrangement, providing stable operation of the valve 40.

Figure 4:
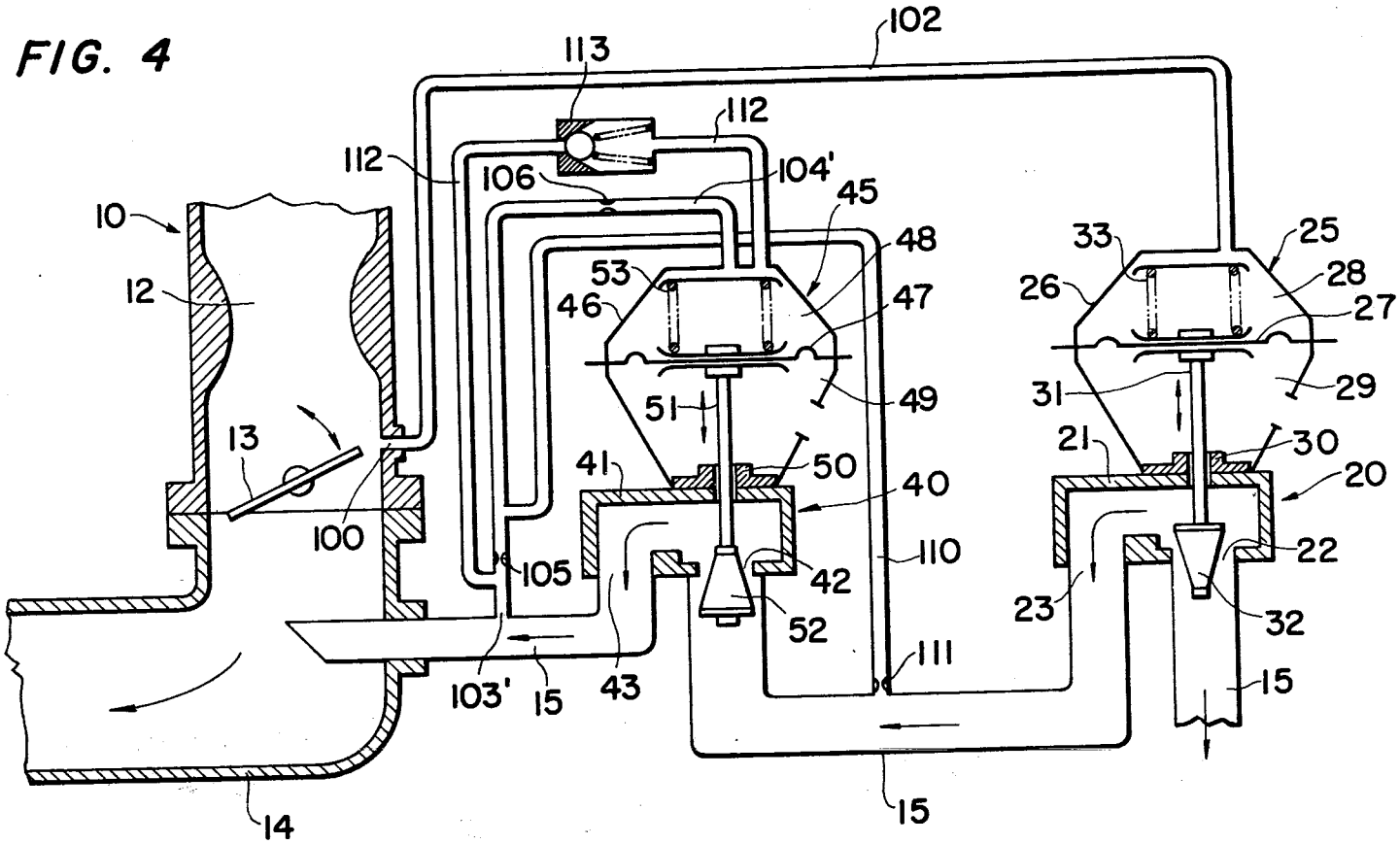
FIG. 4 is a view similar to FIGS. 1 and 3 but showing the system according to a further preferred embodiment of the invention.

FIG. 4 shows a further preferred embodiment of the invention, which differs from the embodiment of FIG. 3 only in that a by-pass conduit 112 branches off from a portion of the conduit 104' between the metering orifice 105 and the intake manifold vacuum sensing port 103'. The by-pass conduit 112 by-passes the orifices 105, 106 and extends to the upper chamber 48 of the servo 45 in parallel with the conduit 104'. There is provided a check valve 113 in the conduit 112 which allows air or gas flow only in a direction from the recirculation conduit 15 to the upper chamber 48. Upon sudden acceleration from low-speed, light-load operation, air slightly under the atmospheric pressure enters the by-pass 112 and chamber 48 through the open check valve 113. The valve 40 opening thus increases. The recirculation rate is thus controlled in quick response to change of the acceleration condition. If the engine decelerates from normal cruising speed, the intake manifold vacuum is gradually conducted into the chamber 48 through the conduit 104' by an amount metered by the orifices 105 and 106, and the recirculation control can be continued for a certain period after initiation of deceleration.

What is claimed is:

1. An exhaust gas recirculation system for an internal combustion engine having an intake pipe connected with an intake manifold, a throttle flap in the intake pipe and exhaust pipe to discharge exhaust gas from the engine, said system comprising: and exhaust gas recirculation conduit feeding part of the exhaust gas to the intake manifold; a first variable-orifice valve disposed in the exhaust gas recirculation conduit and being spring-biased in a direction toward a valve closing position; a second variable-orifice valve disposed in the exhaust gas recirculation conduit downstream of said first valve with respect to exhaust gas flow therein and being spring-biased in a direction toward a valve opening position; means defining a vacuum port opening to the intake pipe in the neighbourhood of the preiphery of the throttle flap in its closed position; means defining an intake manifold vacuum sensing port opening to a portion of the recirculation conduit downstream of the second valve; a first vacuum servo means connected with said vacuum port to increase the open area of the first valve in dependence on the increase in vacuum at said vacuum port; a second vacuum servo means connected with said intake manifold vacuum sensing port to decrease the open area of the second valve in dependence on the increase in vacuum in said vacuum sensing port; a first conduit connecting said vacuum port to said first servo means; a second conduit connecting the intake manifold vacuum sensing port to said vacuum servo means and having two metering orifices formed at the respective end portions thereof; and a third conduit branching off from a portion of the second conduit between the two metering orifices and having a port opening to a portion of the recirculation conduit between the first valve and the second valve.

2. A system according to claim 1, in which the third conduit is formed with a metering orifice adjacent the port opening to the recirculation conduit.

3. A system according to claim 2, further comprising a fourth conduit branching off from a portion of the second conduit between the intake manifold vacuum sensing port and the metering orifice adjacent the intake manifold vacuum sensing port and having a terminal port opening to the second vacuum servo means.

4. A system according to claim 3, further comprising a check valve disposed in the fourth conduit for allowing gas flow only in the direction from the recirculation conduit to the second servo means.

* * * * *